United States Patent [19]

Eberle

[11] 4,356,957

[45] Nov. 2, 1982

[54] CENTRIFUGAL BUCKET

[76] Inventor: Günter Eberle, 100 Gartenstrasse, 7200 Tuttlingen, Fed. Rep. of Germany

[21] Appl. No.: 188,970

[22] Filed: Sep. 19, 1980

[30] Foreign Application Priority Data

Sep. 21, 1979 [DE] Fed. Rep. of Germany ..... 2938317

[51] Int. Cl.[3] ..... B04B 9/12

[52] U.S. Cl. ..... 233/26

[58] Field of Search ..... 233/26, 27; 57/76

[56] References Cited

U.S. PATENT DOCUMENTS 3,578,240 5/1971 Eberle ..... 233/26

3,674,198 7/1972 Eberle ..... 233/26

*Primary Examiner*—Billy J. Wilhite

*Attorney, Agent, or Firm*—Bruce K. Thomas

[57] ABSTRACT

Centrifugal bucket 1, 31 consists of a plastic material 52, in which a U-shaped metal part 2, 32 is imbedded. Receiving grooves 3, 33 for sustaining the pegs of the centrifugal suspension gear are formed in metal part 2, 32, so that in the transmission of the centrifugal force from the bottom of the centrifugal bucket on receiving groove 3, 33 solely the metal part is acting as load transferring connection.

6 Claims, 21 Drawing Figures

Figure 1:
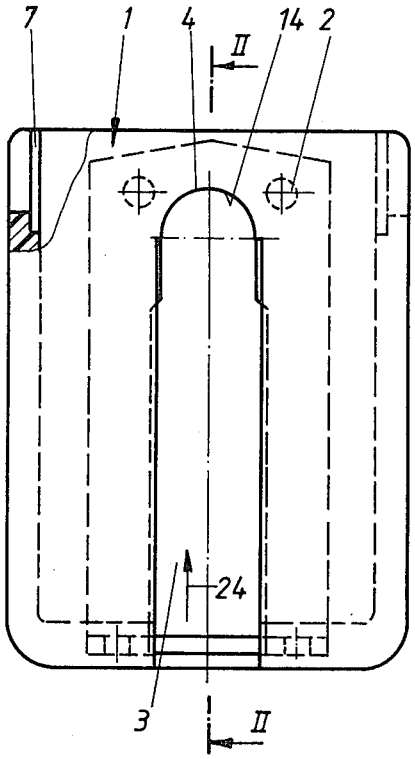

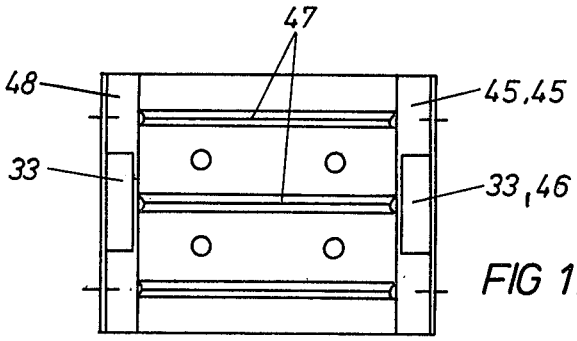
FIG 17
FIG 18
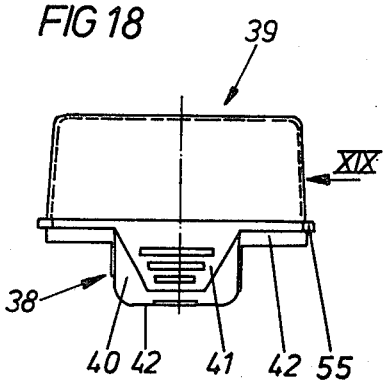
FIG 19
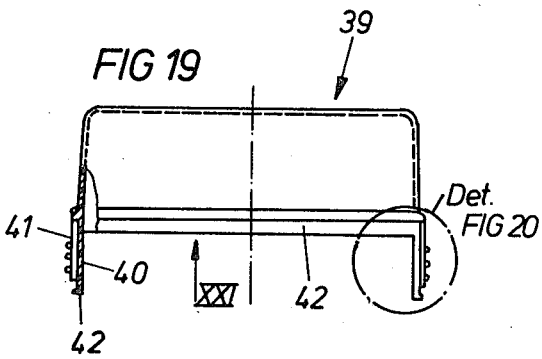
FIG 20
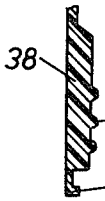
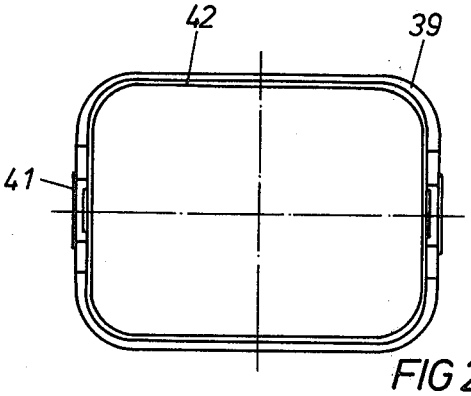
FIG 21

CENTRIFUGAL BUCKET

Object of the invention is to provide a centrifugal bucket to hang on the pegs of the centrifugal spinning head, each wall of which is provided with a receiving groove in the area of the peg fastener on the centrifugal bucket.

The centrifugal buckets known up to the present were produced from a single metal part; by milling and boring out appropriate parts and after adequate treatment there was produced a bucket of solid or precompressed material. Naturally, this method of production is extraordinarily expensive and laborious and after all encumbered by an extremely high consumption of materials. Therefore, the centrifugal buckets having been in use up to now were manufactured of pressed or solid material, since the centrifugal forces acting in centrifuges during the centrifuging are so strong, that so far it was presupposed, only centrifugal buckets produced as one-piece parts would be able to resist such severe forces.

It is the purpose of the present invention to further develop a centrifugal bucket of the above mentioned kind in such a way, that the product exhibits equally good strength and durability as compared with the prior art, costs of production and materials are reduced considerably.

For the solution of the task in question, the invention is distinguished by, providing a centrifugal bucket consisting of a plastic material having a metal part imbedded in the plastic material.

The invention overcomes the prejudice that a centrifugal bucket must be, made of a one-piece solid or compressed metal part, to withstand the impact of the centrifugal forces. Thorough tests have established that equally good strength and durability values may be attained by embedment of a metal part in a plastic material, also the costs of production and materials are substantially reduced. However, it is essential in imbedding the metal part in the plastic material, that the metal part is imbedded in such a manner, that it accepts an essential part of the forces (taken up by the receiving groove), acting from the suspending pegs of the centrifuge on the centrifugal bucket. It is preferable that the metal part is shaped as a U-profile, whose legs are arranged parallel to the receiving groove and provided with a fastener at the legs for reception of the centrifugal pegs.

By shaping the metal part as a simple U-profile, the advantage of lesser production costs has been achieved, because it has been proven, that a closed bucket is not required, since such a U-profile is entirely sufficient for completely accepting and distributing the forces acting from the centrifugal pegs on the receiving groove of the centrifugal bucket.

It is hereby preferable that the fastener arranged on the legs is shaped like an embrasure or groove of the legs running parallel to the receiving groove, the upper limitation of which is provided with a radius, adapted to the radius of the pegs of the centrifuge.

This means, that the pegs are led into the receiving groove at both sides of the centrifugal bucket, whereby the upper limitation of the receiving groove (during the spinning process this is the limitation of the receiving groove, lying radially inward) is shaped by the metal part, at this place showing a radius, which is adapted to the radius of the peg.

At this spot, all the forces activated by the pegs of the centrifugal suspension gear are thus transmitted to the legs of the metal part. Since the metal part is a symmetrical U-profile, the forces are diverted to the closed base leg of the U-profile.

In order that the suspension of the pegs and the guiding of the pegs into the receiving groove on the side of the centrifugal bucket are facilitated, the lower part of the receiving groove (the part lying radially outwards) has been widened, so that the pegs may be entered easily.

First in their upper part (lying radially inwards) the width of the receiving groove has been adapted to the diameter of the pegs, so that these are contained with only a slight play by the radius of the metal part.

In an additional model or embodiment of this invention the metal part was shaped as a U-profile as well, however no embrasure or groove running from the bottom area upwards with a wider diameter has been planned, which is opening into an embrasure or groove of a more narrow diameter, whereby the width of the latter embrasure or groove is slightly larger than the diameter of the peg of the centrifugal suspension gear which is to be suspended. In this second example of the invention the receiving groove was not shaped as a cut out embrasure, but as an indenture or elongated indentation in both the opposite legs of the U-profile. By this an even better mechanical loadability of the metal part results, because embrasures which weaken the cross section have been avoided. The metal part shows bent off legs, starting at the bottom area, rising upwards by holding a certain distance and showing bendings pointing outwards in the area of the beginning of the receiving groove, so that both the legs have a larger spacing in the upper free area than in the bottom area. Thus, the possibility has been created to produce the receiving groove, shaped as an indenture of the metal part material, without hereby having to pierce the material of the legs. There is also an additional advantage in shaping the receiving nut as an indenture, namely that the upper part of the receiving groove, which is highly loaded by the peg of the centrifugal suspension gear, becomes especially stable in its shape, while the material of the metal part is bent horizontally outwards in the area of the "roof" of the receiving groove and thus an extraordinarily loadable, power transmitting connection has been established from the peg of the centrifugal suspension gear on the metal part imbedded in the plastic material.

Furthermore, it is essential for this embodiment of the invention that the receiving groove itself is not lined or cased with plastic, so that in this mechanically highly loaded area, the material of the metal part solely is lying close to the peg of the centrifugal suspension gear, while the plastic material is imbedded in the metal part and only serves to hold the distance of the free legs of the metal part and in addition as fill material.

Instead of shaping the metal part from a U-profile with two free legs, it may also be considered in a further model, which has not been laid down in detail yet, where this metal part will be shaped as a continuous bowl, closed in itself.

In case the second example of a model is preferred, by shaping the metal part as a U-profile there is anyway an essential saving of material and weight, since the walls of the centrifugal bucket adjoining the metal part were formed of the plastic material, so that altogether (plastic material plus metal part) result in a closed centrifugal bucket, only open on top.

Beyond that, the metal part of the second model is still showing ripplings (knuckles) in the bottom area and at least partially in the area of the lateral legs, which are further improving the mechanical strength and stability of shape.

Another essential feature of the present invention is, that the centrifugal bucket, which is open on top, is lockable by a tightly closing cap, whereby in a preferred model a notch connection between the cap and the top side of the centrifugal bucket has been provided. By application of a tightly closing cap as a closure of the centrifugal bucket, the advantage has been achieved that for liquid spinning substances the forming of aerosol and a possible spraying of this aerosol during the spinning process on the surrounding of the centrifuge will be prevented. This is particularly undesirable when preparing infectious material. Up to now, compressed air rotors, rotating simultaneously were used for this purpose, but they were extremely costly and rendered the operation of the centrifuge rather difficult.

After the present invention, simply a tightly closing cap is used, so that the costly air rotor, which is cumbersome to operate, may be eliminated.

It is important that the metal part does not extend to the rim of the centrifugal bucket, but that the plastic material is used in the area of the rim. Hereby the entire centrifugal bucket with the metal part may be produced by the injection molding process, and the edge running around the top may be equipped with a projection, in using the injection molding process, by means of appropriate forming of the tool. The projection will then have a notch connection with the cap.

Various materials may be chosen for producing the metal part. A glass fiber-reinforced plastic material may be used for this purpose, or various metals, as for instance stainless steel, steel plate or a high-strength aluminum alloy. It has, however, been established that the most profitable choice of material is a metallic insert of high-strength light metal, which, moreover, has the advantage of being more weight saving than other metals. Hereby, at an equal r.p.m., the centrifugal force, and thereby the force in the receiving groove to be transferred to the metal part, becomes lesser, than if a heavier metal had been used.

In the following, the invention will be elucidated more closely, purely by means of diagrams showing several methods of execution. Thus, further features, essential to the invention, and advantages of the invention will be evident from the drawings and their description.

Figure 2:
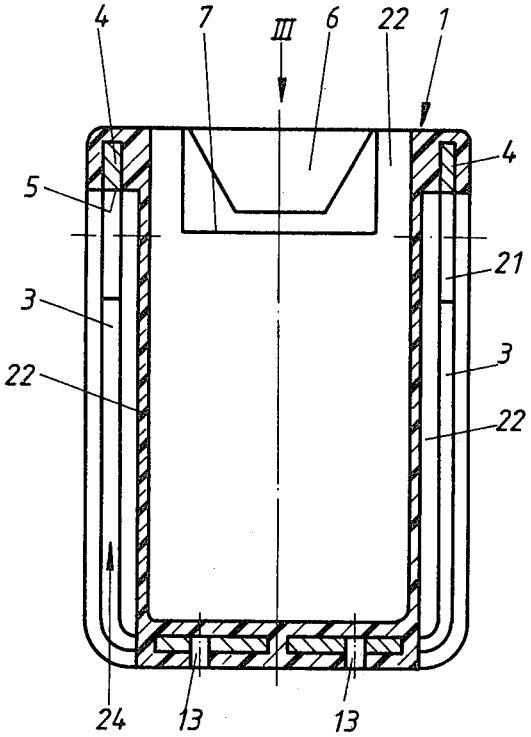
Figure 3:
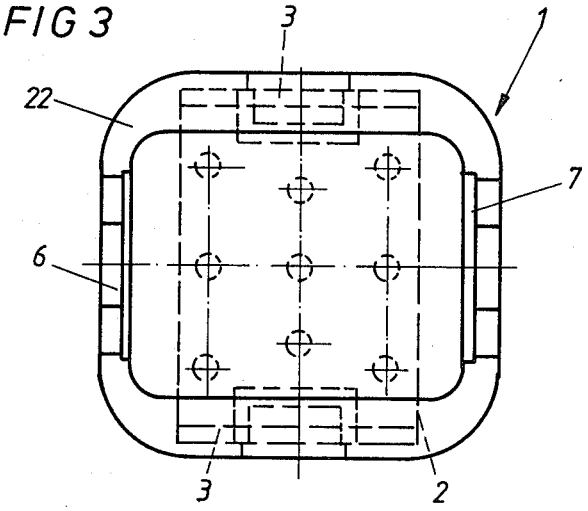
Figure 4:
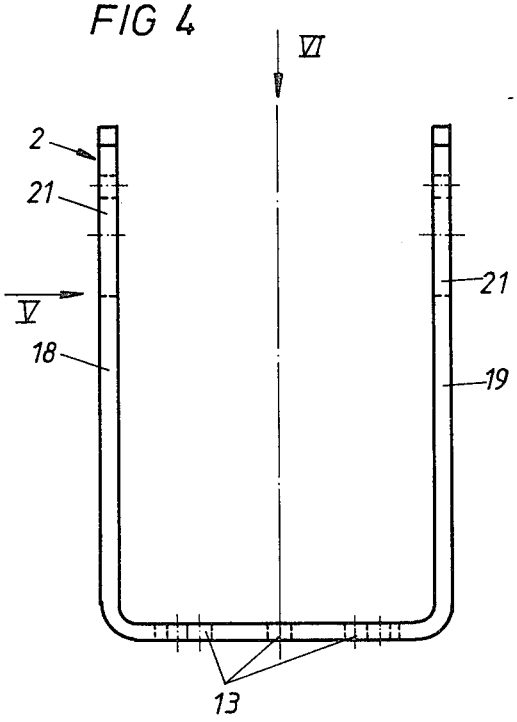
Figure 5:
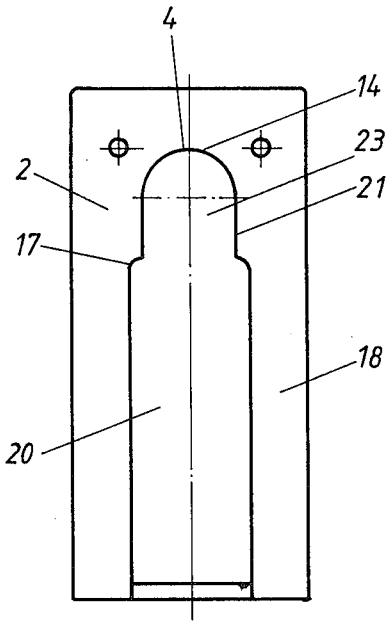
Figure 6:
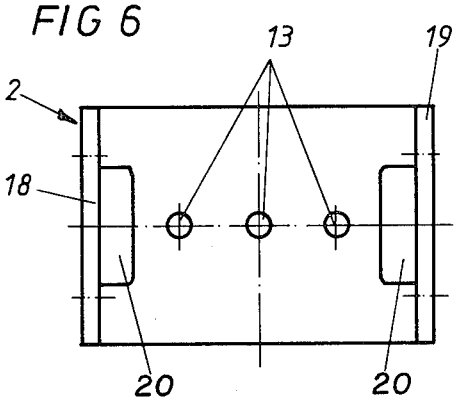
Figure 7:
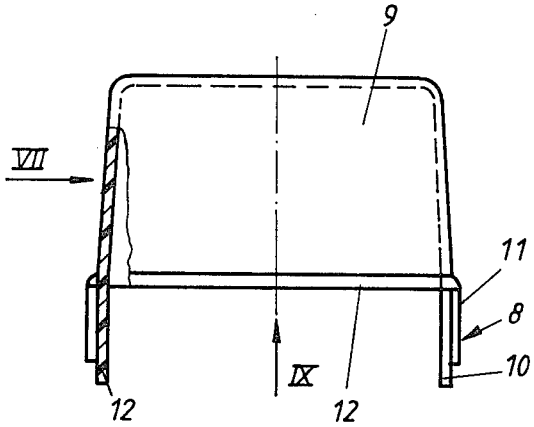
Figure 8:
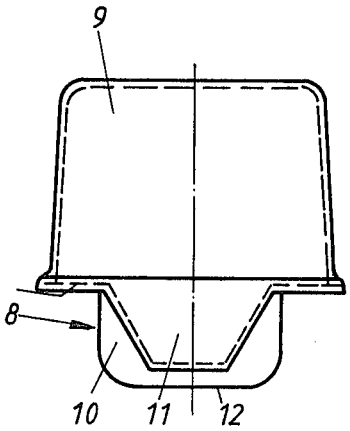
Figure 9:
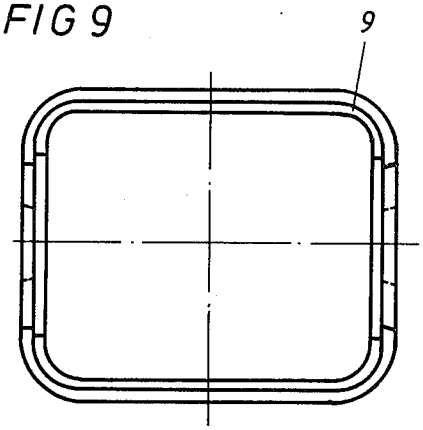
Figure 10:
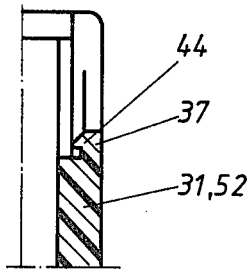
Figure 11:
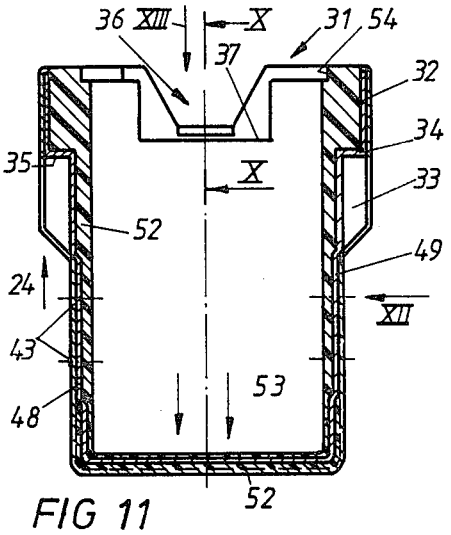
Figure 12:
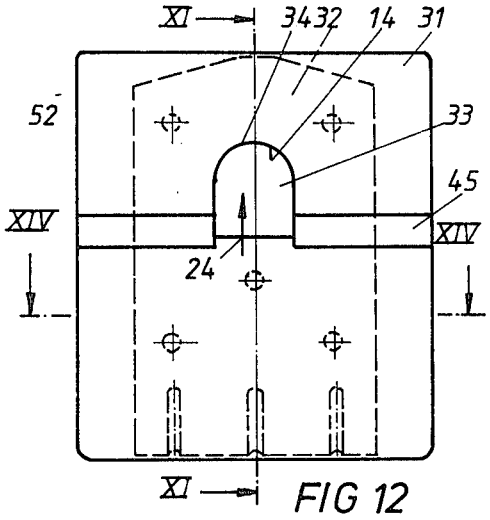
Figure 13:
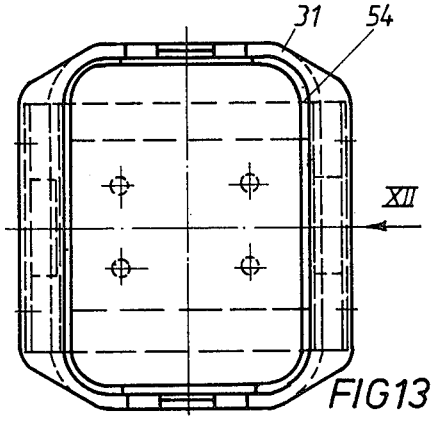
Figure 14:
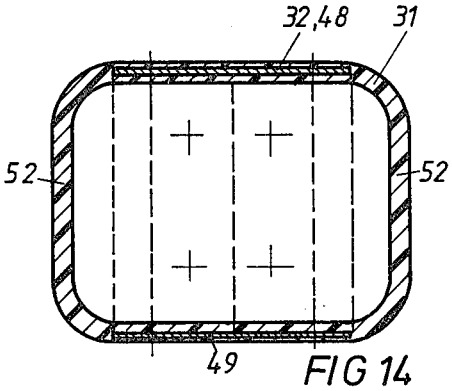
Figure 15:
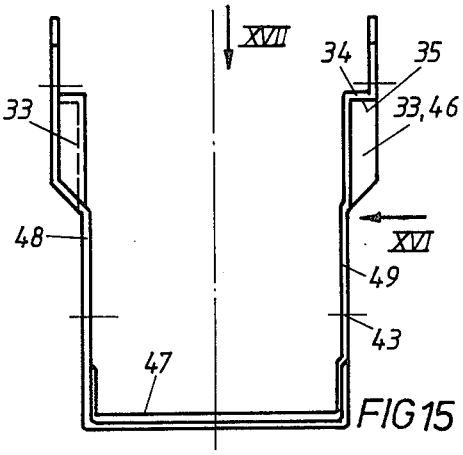
Figure 16:
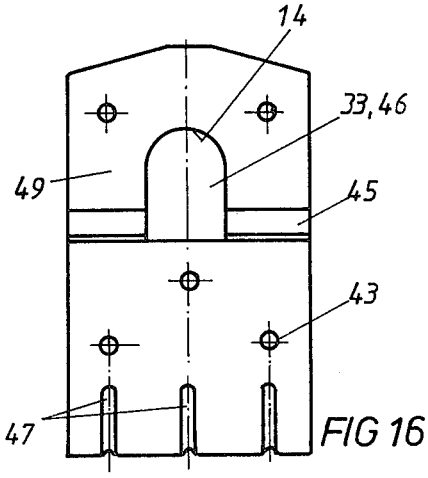

Other objects and many attendant advantages of the invention will become apparent and understood by reference to the following more detailed description, in reference to the accompanying drawings wherein:

FIG. 1 Side view of the centrifugal bucket with the imbedded metal part,

FIG. 2 Section in accordance with line II—II in FIG. 1,

FIG. 3 Top side view in the direction of arrow III in FIG. 2,

FIG. 4 Side view of the metal part,

FIG. 5 Side view in the direction of arrow V in FIG. 4,

FIG. 6 Top side view in the direction of arrow VI in FIG. 4,

FIG. 7 Side view of the cap with which the centrifugal bucket is closed,

FIG. 8 View in the direction of arrow VIII, in accordance with FIG. 7, on cap, FIG. 9 Underside view of the cap in the direction of arrow IX in FIG. 7, FIG. 10 Section in accordance with line X—X in the second example of a model of a centrifugal bucket, in accordance with FIG. 11, FIG. 11 Section view of the centrifugal bucket in the second model, in accordance with section XI—XI in FIG. 12, FIG. 12 Side view of the centrifugal bucket, after FIG. 11 in direction of arrow XII, FIG. 13 Plan view of the centrifugal bucket, after FIG. 11, in direction of arrow XIII, FIG. 14 Section in accordance with line XIV—XIV in FIG. 12, FIG. 15 Side view of the metal part, FIG. 16 Side view, turned 90 degrees, of the metal part, after FIG. 15, in direction of arrow XVI, FIG. 17 Plan view of the metal part in direction of arrow XVII in FIG. 15, FIG. 18 Side view of the cap in the second example of a model, FIG. 19 Side view of cap, turned 90 degrees, according to arrow XIX in FIG. 18, FIG. 20 Detailed diagram of the butt strap of the cap, according to FIG. 19, FIG. 21 Underside view of the cap according to direction of arrow XXI in FIG. 19.

In a preferred embodiment of the present invention, the plastic material of the centrifugal bucket consists of a polyamide with 35% glass fiber content. FIGS. 1 to 4 show centrifugal bucket 1, together with metal part (reinforcement part) 2, while FIGS. 4 to 6 depict metal part 2 only. The metal part consists of a high-strength light metal (tungsten steel).

In the connection of FIGS. 1 to 3 with the depiction in FIGS. 4 to 6 it is obvious that the imbedded metal part 2 is solidly surrounded by the plastic material, respectively the plastic material has been sprayed around it, and from the outside (with the exception of radius 14) it is not visible anymore. In FIGS. 1 to 3 metal part 2 is depicted hatched. On two sides of centrifugal bucket 1 there are receiving grooves 3 in the metal part 2, which have been provided for guiding the suspension pegs of the centrifugal suspension gear into place.

The pegs of the centrifugal suspension gear, which have not been depicted pass into receiving groove 3, in the direction of arrow 24 when the bucket is placed thereon. Metal part 2, according to FIG. 2, in the area of receiving groove 3, has been recessed, so that the receiving peg ultimately contacts the curved or arcuate underside 5 of upper limitation 4 of metal part 2. Hereby the internal radius 14 of limitation 4 of metal part 2 has been adapted to conform with the external radius of the pegs.

The inside of the centrifugal bucket is of plastic material 22, according to FIG. 2. In order to prevent a displacement of the metal part in regard to the injection mold during the spraying procedure, the metal part, according to FIGS. 2 and 4, has been provided with drillings 13 in its bottom area, through which the centering pegs of the mold engage, so that metal part 2 remains centered in the injection mold.

The upper opening of centrifugal bucket 1 shows two opposite embrasures or grooves 6 in the side walls of centrifugal bucket 1, into which an appropriately coordinated butt strap 8 of cap 9 engages (see FIG. 7). The cap consists of a polycarbonate plastic material.

Butt strap 7 consists here of an outer part 11 and an enlarged inner part 10. Inner part 10 is adjoining the inside of centrifugal bucket 1 at a recessed rim 7, while outer part 11 may be equipped with adequate ripplings, in order to facilitate grasping and extracting cap 9 from the opening of centrifugal bucket 1. Besides, cap 9 is provided with a circular edge 12, which is sealingly adjoined to the coordinated plans (or cooresponding parts) of the centrifugal bucket 1. By this the cap is mounted absolutely tight, and therefore it is not necessary anymore to use a rotor spinning along, since a harmful aerosol formation of the spinning substance is prevented during the spinning process by means of the tightly closing cap.

In FIGS. 4 to 6 the metal part (imbedded part) has been depicted separately. It is hereby important, that metal part 2 is shaped as a single U-profile with lateral legs 18, 19. Legs 18, 19 show three grooves or embrasures in the area of the receiving groove, whereby the lower embrasure 20 of larger width with a nip 17 passes into a decreased area 21 of groove or slat 23, whose upper limitation 4 closes with a radius 14. The peg of the centrifugal suspension gear then adjoins this upper limit 4 and this radius 14.

Centrifugal bucket 31 depicted in FIGS. 11 to 14 is, on the other hand, showing a metal part 32 imbedded in the plastic material. Metal part 32 is imbedded to such a degree in plastic material 52 of centrifugal bucket 31, that metal part 32 is only separated in the bottom area, according to FIG. 11, by a thin layer of plastic material 52, thus forming the bottom of centrifugal bucket 31. The centrifugal force produced by the spinning substance will be transferred to this bottom in the direction of arrow 53, where it will be transferred via legs 48, 49 (Compare FIG. 15) of the metal part to receiving groove 33 on both sides of legs 48, 49. According to FIGS. 12 and 16, the suspension peg of the centrifugal suspension gear is adjoining in receiving groove 33, by which the radius of the peg matches radius 14 at the upper limit 34 of receiving groove 33.

In order to achieve a better imbedding of metal part 32 in plastic material 52 of centrifugal bucket 31, the metal part, according to FIGS. 15, 16 and 12, has been equipped with bore holes 43, so that plastic material 52 passes through these bore holes from the inside of the centrifugal bucket in direction of the outer side, and hereby, in comparison, the metal part is shot through or penetrated by "plastic bolts".

The suspension peg of the centrifugal pendant, which is not depicted in detail, passes into receiving groove 33 in direction of arrow 24, where it contacts the underside 35 of the metal part 32. It is essential, that receiving groove 33 is formed by an indenture 46 of metal part 32 in the area of receiving nut 33 (compare FIGS. 15 and 16), so that the highly loaded upper limit 34 of receiving groove 33 (underside 35) consists of the indented material of metal part 32. By this an extraordinarily highly loaded, form-stable construction of receiving groove 33 has been established, which is also able to transfer the strongest centrifugal forces.

In order to increase the form stability of metal part 32 further, the bottom area of the metal part, according to FIGS. 15 and 16, has been equipped with knuckles 47, having been arranged at a parallel distance, in a juxtaposed manner, which, according to FIG. 16, do also partially extend to the lower area of legs 48, 49.

Hereby the advantage results that by means of the knuckles 47 the stability of form has been improved, and in comparision with a metal part of equal strength without knuckles, the present metal part with knuckles is substantially thinner and thereby it will be easier to form.

Centrifugal bucket 31 consists of plastic material 52, in its upper area near circular rim 37, by which the advantage has been gained, that circular rim 37, with appropriate projections, may be formed of plastic material (compare FIG. 10).

In the example of a model shown, circular rim 37 is exhibiting a projection 44, which is coordinated and snap-fits with projection 50 on cap 39, according to FIGS. 18 to 21.

Top circular rim 37 of the centrifugal bucket is equipped with an embrasure groove or notch 36 on two opposite sides, into which butt strap 38, shown in FIGS. 18 and 19, of cap 39 engages. This butt strap seals inner part 40 on the inner side of embrasure or notch 36, while the contour line of outer part 41 of the butt strap matches the shape of embrasure or notch 36, according to FIG. 11.

Outer part 41, according to FIG. 20, is provided with handle grooves 51, so that cap 39 may be easily pulled off the centrifugal bucket. This is done by pressing handle grooves 51 inwards on both sides, with the hand, whereby projection 50 on butt strap 38 gets out of engagement with projection 44 at rim 37 (see FIG. 10) of centrifugal bucket 31, and the notch connection is hereby interrupted.

Circular edge 42 of cap 39, arranged in the area outside pegs 38, is, in accordance with FIG. 18, overlapped by a collar 55, by which a cooperating edge 54 (see FIG. 11) on the top side of centrifugal bucket 31 is coordinated with edge 42. Collar 55 of cap 39 is then mounted on the top side as a stop, while edge 42 of cap 39 seals against the edge 54 of centrifugal bucket 31.

The forming of receiving groove 33 as indenture 46 may be especially simply produced by metal part 32 having a deflection 45 in the area of the lower open end of receiving groove 33, and then extending continuously upwards with greater width.

The advantages of both the described examples of models are especially to be seen in, that in a surprising manner it has been possible to successfully produce a high-strength and highly loadable centrifugal bucket, which in relation to its weight is considerably lighter than the centrifugal buckets known up to now, which either consist of pre-molded pressed metal or have been worked of solid material. By producing the centrifugal bucket by the pressure die casting process, wherein the metal part is immediately placed in the die mold and imbedded in the plastic material, especially low production costs result. By providing a connection transferring the load from the receiving groove of the one side over the bottom area to the receiving groove of the other side, which is solely taken over by the metal part, a centrifugal bucket results which is also able to stand the heaviest loads and signifying such a saving of weight, as it would not have been anticipated to be possible previously.

I claim:

1. A centrifugal bucket for suspension from the pegs of the spinning head of a centrifuge comprising:

a cup-shaped plastic receptacle having side walls defining opposed external recesses adapted to receive said pegs;

a reinforcing member associated with said receptacle extending across the bottom thereof and having elongated leg members extending within said recesses;

the termini of said leg members defining a load-bearing surface engageable with said pegs to thereby suspend said receptacle from said spinning head.

2. A centrifugal bucket in accordance with claim 1 in which said external recesses of said receptacle terminate in arcuate end walls and said reinforcing member comprises a U-shaped metal piece, the leg members of which define conforming arcuate end walls continuous with the arcuate end walls of said recesses to form said load-bearing surface engageable with said pegs of the spinning head.

3. A centrifugal bucket in accordance with claim 1 including:

a removable cap member for said cap-shaped receptacle;

said cap member having a pair of opposed butt straps extending from the bottom edge;

said cup-shaped receptacle having a pair of opposed recesses in the top edge;

said butt straps of said cap member mating with the pair of recesses in said receptacle in a sealed snap-fit relationship.

4. A centrifugal bucket in accordance with claim 1 in which:

said reinforcing member comprises a U-shaped metal piece having its lower leg portions and bottom imbedded in the plastic walls and bottom of said receptacle and a plurality of indentations is provided in said leg portions and bottom of said reinforcing member to engage said plastic.

5. A centrifugal bucket for suspension from the pegs of the spinning head of a centrifuge comprising:

a cup-shaped plastic receptacle having side walls defining opposed external longitudinal grooves adapted to receive said pegs;

a reinforcing member associated with said receptacle and having its bottom imbedded within the bottom of said receptacle and having elongated leg members imbedded within said side walls;

each of said leg members defining a slot extending along said grooves of said side walls, and the upper ends of said slots of said reinforcing member defining a load-bearing surface to thereby engage said pegs and suspend said receptacle from said spinning head.

6. A centrifugal bucket in accordance with claim 5 wherein:

the upper ends of said slots have edges that are constricted to a spacing substantially equal to the diameters of said pegs and said load-bearing end surfaces have radii conforming to the radii of said pegs.

* * * * *